United States Patent [19]

O'Toole

[11] 4,101,857

[45] Jul. 18, 1978

[54] EXTERNALLY-PROGRAMABLE SWITCH

[76] Inventor: Lawrence P. O'Toole, 80 Steiner Ave., Neptune City, N.J. 07753

[21] Appl. No.: 724,511

[22] Filed: Sep. 30, 1976

[51] Int. Cl.[2] ..... H01H 9/00

[52] U.S. Cl. ..... 335/206; 335/207

[58] Field of Search ..... 335/205, 206, 207

[56] References Cited

U.S. PATENT DOCUMENTS

| | | | |
|---|---|---|---|
| 3,660,789 | 5/1972 | Weisenburger | 335/206 |
| 3,685,041 | 8/1972 | Kondur | 335/206 X |
| 3,719,887 | 3/1973 | Shimizu et al. | 335/206 X |

*Primary Examiner*—George Harris

*Attorney, Agent, or Firm*—Charles F. Gunderson

[57] ABSTRACT

A magnetically-actuated switch has a stationary mounting base to which a plurality of magnetically-actuated reed-type switches are secured in a layer parallel to the base. A moveable portion of the switch is pivotably mounted to the mounting base, and contains a plurality of magnets positioned to actuate the reed-type switches in any desired sequence. A second layer of magnetically-actuated, reed-type switches may be positioned, parallel to the mounting base, below the above-mentioned layer, and additional magnets may be added to the moveable portion, to supplement the existing magnets, and increases the magnetic field in certain portions of the moveable portion to effect the lower layer of reed-type switches.

4 Claims, 8 Drawing Figures

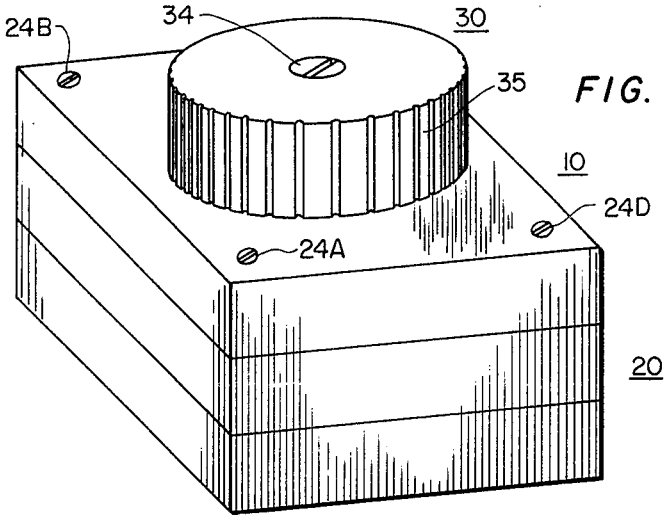
FIG. 1
FIG. 2
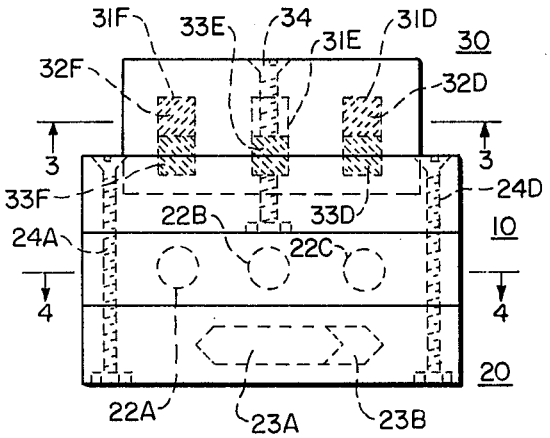
FIG. 3
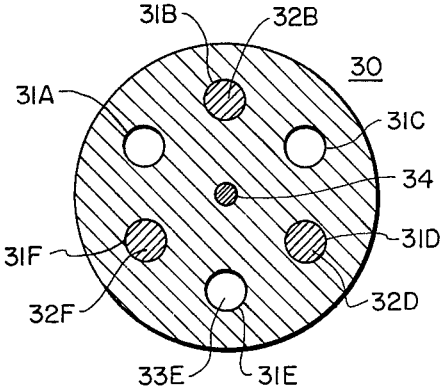
FIG. 5
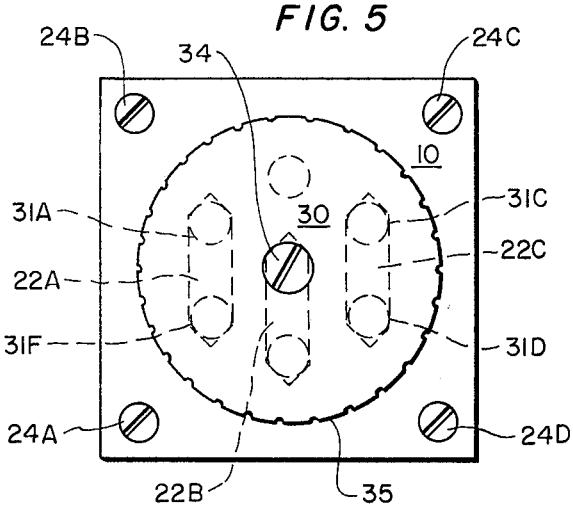
FIG. 4
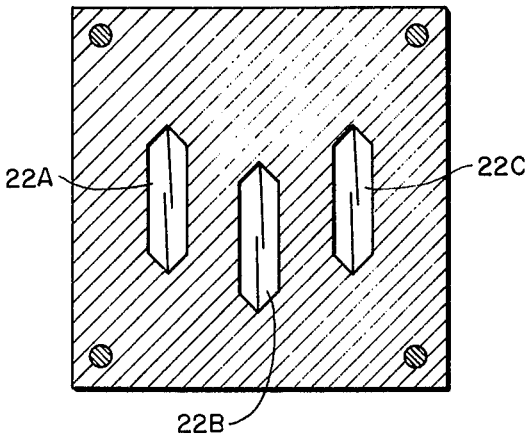

EXTERNALLY-PROGRAMABLE SWITCH

BACKGROUND OF THE INVENTION

Magnetically actuated, reed-type switches are fairly-well known, and are quite reliable in the present state of the art. They are particularly valuable and useful in situations where electrical contacts are necessary, but the inevitable arcing of the electrical switching would be hazardous. Not only would the arcing be hazardous in combustible atmospheres, but the atmosphere itself may be damaging to the switch contacts. The oxygen in the air oxidizes the contacts; the caustic vapors in the air corrode the contacts; and the dust in the air causes malfunction of the contacts.

However, most of the reed-type switches and their magnetic controls are single units, designed for specific installations or functions, and may or may not be adaptable to other uses.

Compound switches are also very well known and have many types including the common rotary switches that can have a plurality of peripheral contacts to be actuated in a variety of ways, in continuous or reciprocal motions, to provide an almost infinite variation of switching functions. Each layer of rotary switches can provide several functions and many layers of switches can be used to provide various additional combinations of functions.

However, almost all of the rotary switches must have fixed contacts, and once a given switching sequence is set up on any one of the layers of switches, it cannot be changed without rebuilding or rewiring the switch. In any case almost all of the conventional, rotary switches would have the inevitable arcing problems that would preclude their use in certain areas, as well as the susceptibility to oxidation, corrosion and malfunction, as noted earlier. Lastly, almost all of these compound switches may be limited in the amount of current and voltage that they can carry without permanent damage.

It is therefore an object of this invention to provide a rotary switch with reed-type switching elements that can control relatively high currents and voltages without any potential hazard due to arcing or damage to the contacts due to atmospheric conditions. It is a further object of this invention to provide a compound rotary switch that can be set up to provide a series of complex switching functions, for any desired purpose, wherein both the combinations of switches and the combinations of the actuators of the switches can be varied at will to perform other complex switching functions, by very simple mechanical changes, without having to change any electrical contacts.

SUMMARY OF THE INVENTION

A rotary switch has a rotary, moveable portion pivotably attached to a mounting base. The rotary portion has a series of holes or slots positioned at given intervals around the rotary portion; each of the slots formed to accommodate a given magnet or combination of magnets. These magnets, or combinations of magnets, are designed to actuate one or more magnetically-actuated, reed-type switches that are positioned in one or more layers under the mounting base. The arrangement of the reed-type switches may be varied in any layer to cooperate with the pattern of magnets in the rotary portion to provide any desired switching function. The layers and combinations of switches within the layers may be varied at will, along with the orientation and combination of the magnets, to change the switching functions of the basic switch.

BRIEF DESCRIPTION OF THE DRAWINGS

FIG. 1 shows an isometric view of a preferred embodiment of the invention;

FIG. 2 shows a vertical cross section of the species of FIG. 1;

FIG. 3 shows a horizontal cross section of one portion of FIG. 2;

FIG. 4 shows a horizontal cross section of another portion of FIG. 2;

FIG. 5 shows a top view of the species of FIG. 1;

DESCRIPTION OF THE PREFERRED EMBODIMENT

Figure 6:
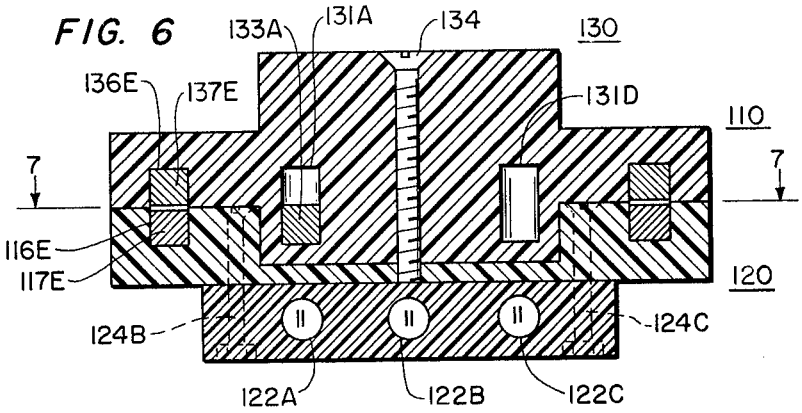
FIG. 6 shows a vertical cross section of another species of this invention.

Referring now more particularly to FIG. 1 an isometric view is shown with a mounting base 10, a stationary portion 20, and a rotary, moveable portion 30. The mounting base is seen to have bolts 24A—D to secure the stationary portion 20 to the mounting base. The rotary, moveable portion may have a pivot bolt 34, and, since the rotary portion may be manually controlled, it may be knurled, as at 35, to facilitate manual control.

FIG. 2 is a side view of the species of FIG. 1, wherein the same elements — as in all of the figures — have the same numbers. In FIG. 2, certain of the inner elements are shown in dotted lines to show their positioning and the relationship of the elements. FIG. 2 shows, for example, that the mounting base 10 may be recessed to accommodate the rotary, moveable portion 30, whose pivot bolt 34 is seen to hold the two portions in a pivotable relationship. This figure also shows some of the holes or slots 31A–F that may contain upper magnets 32A–F and lower magnets 33A–F whose magnetic fields will penetrate the mounting base 10 and the stationary portion 20 to actuate the reedtype switching elements in the stationary portion. Some of these magnets will be seen in a typical positioning in the cross section of FIG. 3 to be described later.

The stationary portion 20 is seen to be secured to the mounting base 10 by the mounting bolts, such as 24A and 24D. The stationary portion is seen to include an upper layer with reed-type switches 22A–C and a lower portion with reed-type switches 23A and 23B visible from this angle. These reed-type switches will be more clearly seen in the cross section of FIG. 4 to be described later.

FIG. 3 shows a horizontal cross section of the rotary, moveable portion of the device of FIGS. 1 and 2, along the lines 3—3 of FIG. 2. This is a cross section of the upper part and its magnets, and shows that only certain of the holes or slots 31A–F may include magnets, such as 32B, 32D, and 32F. The lower part of the rotary, moveable portion may have magnets 33B, D, and F, not seen, as well as 33E. Certain of the holes or slots, such as 31A and 31C, must have no magnets, or must have magnetic polarities reversed, or there could be no switching function in one or both of the layers.

FIG. 4 shows a horizontal cross section of the upper layer of the typical reed-type switches 22A, 22B, and 22C. This layer is seen to be positioned 90° around from the lower layer although they could also be superimposed. The orientation of the reed-type switches and the possible variations will be discussed in the operation of this device.

FIG. 5 shows a top view of the overall device of FIG. 1, with dotted lines, as in FIG. 2, again showing the general layout of the magnets and of certain of the switching elements. The knurled portion 35 of the rotary handle 30 is again seen as is the pivot bolt 34. The mounting base 10 surrounds the rotary portion 30 and the mounting bolts 24A–D are seen, securing the stationary portion to the mounting base.

FIG. 5 shows the holes or slots 31A–F positioned above the end portions of the reed switches 22A, B and C. The switches 23A–C of the next, lower layer are omitted for clarity. However, since they may be in quadrature, it will be apparent that they will have a similar relationship to the magnets of the rotary, moveable portion when the magnets are in a corresponding orientation.

FIG. 6 shows a vertical cross section of another species of this invention along the lines 6—6 of FIG. 7 (to be described next). This species has the basic elements of the species of FIGS. 1–5, with the magnet holes or slots now identified as 131A–F; the lower magnets identified as 133A–F and the pivot bolt is 134. The mounting bolts are 124B and C and, again, secure a layer of reed-type switches 122A, B, C. The second layer of switches, as seen in FIGS. 1, 2, and 5 are omitted for clarity, although it will be obvious that they could be accommodated here. Since only one layer of switches is being used, a single layer of magnets is all that would be necessary for this version of the device.

The species of FIG. 6 has the addition of detent magnet holes 136A–L to accommodate any one, or a variety of combinations or magnets. These holes may be established in a peripheral ring, outside of the switching magnets, as will be seen in FIG. 7. The magnets 137A–L in the rotary portion will cooperate with magnets 117A–L in any one or more of the corresponding holes 116A–L in the extended mounting base of this device seen in FIGS. 6–8.

Figure 7:
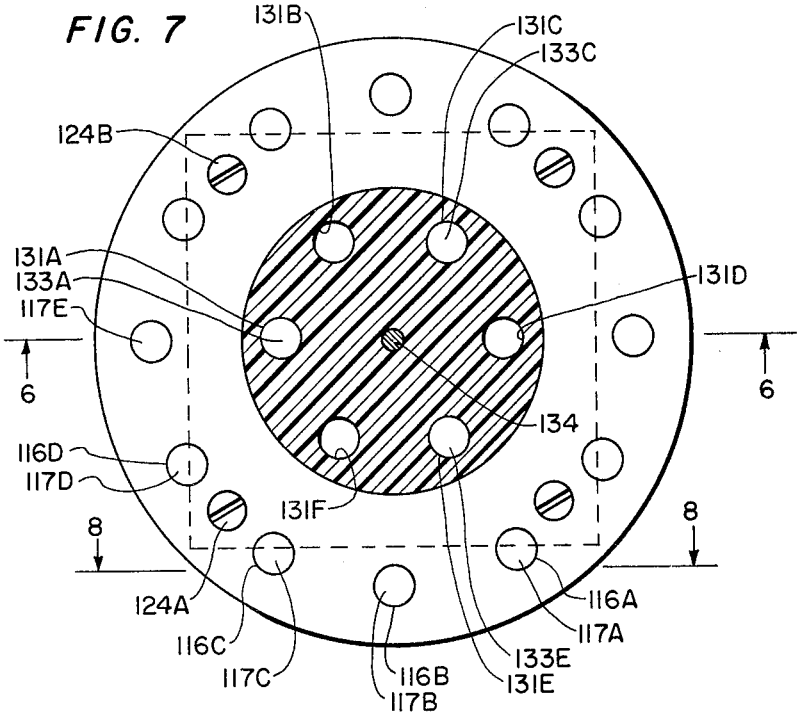
FIG. 7 shows a horizontal cross section of the species of FIG. 6.

FIG. 7 shows a horizontal cross section of the device of FIG. 6 along the lines 7—7 of FIG. 6. This shows, more clearly, the peripheral layout of the holes 136A–L and the magnets such as 137A, B, C, D, and E, in a typical layout. One or more magnets must be provided in the stationary detent ring in the extended mounting base although they cannot be seen, nor can their polarization be shown, in the manner essential to the operation of this device, in the cross section.

Figure 8:
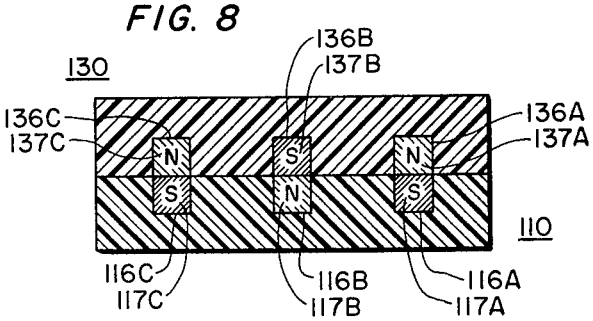
FIG. 8 shows a vertical cross section of a portion of FIG. 7.

FIG. 8 shows a vertical cross section of the species of FIGS. 6 and 7 along the lines 8—8 of FIG. 7. This line is chosen to cut across at least three of the pairs of magnets to show at least one orientation of the magnets 137A, B, and C, in the corresponding holes 136A, B, and C of the rotary portion. The corresponding magnets 117A, B, and C are shown in the holes 116A, B, and C of the extended mounting base 110.

In operation, magnets are placed in certain of the holes, such as 31A–F of FIG. 3. These magnets must be strong enough to actuate a reed-type switch such as 22A–C. The switches are oriented in such a manner that they may be actuated — or nonactuated — by the magnet being of one polarity or the other, or by being above one or the other of the ends of the reed-type switches. A typical orientation of the magnets and the switches is shown to accommodate one type of switching functions, but it will be obvious that other orientations and numbers of switches are possible.

The magnets can be oriented to actuate certain of the switches at certain angles of rotation of the moveable portion to perform the desired switching function. Not all of the holes such as 31 would be filled with magnets, or with magnets of the same polarity, or there may be no switching function. If two layers of the switches are being used, the magnets would be doubled where necessary to affect both layers.

Additional layers of switches could be accommodated by the use of additional or stronger magnets, and are within the scope of this invention, but the control of the switches will obviously become less positive as the layers are increased. Too many layers of switches would produce a more likelihood of errors, or interaction of the magnets, as their numbers are increased.

Once a given switching function is set-up within the device, it is obvious that a mark or label on the mounting base could be established to cooperate with an arrow or other indicator on the rotary moveable portion to establish any given setting.

An established position of the rotary portion, with respect to the base portion, may be established in a well-known manner by mechanical detent devices that would arrest the motion of and hold the rotary portion in a given orientation.

An improved detent system is seen in the species of FIGS. 6, 7, and 8. Here the detent is established by detent magnets in the rotary portion and in the base portion that will interact with each other to hold the device in any desired position or series of positions. These positions need not be uniform and, unlike most mechanical detent mechanisms, they can be interchanged at will by changing the positions or polarities of the detent magnets.

FIG. 7 shows 12 such detent holes, and FIG. 8 shows a cross section of portions of three of them to show one potential sequence of magnetic polarities. In this sequence, the detent magnets will lock together in the N–S, S–N sequence. The magnets should be strong enough to make a firm hold in this position but not so strong that an average operator cannot rotate the moveable portion to the next detent. In this particular sequence, as the moveable portion is rotated, it will move into the N*–N, S–S, N–N configuration, which will, in effect, "toggle", the device on to the next S–N, N–S, S–N, etc. configuration.

The locking of the moveable portion in a precise position by this means will insure accurate actuation of the device and positive switching.

As noted earlier, the magnetic detent is not limited to a single pre-set pattern, since the magnets can be removed or changed about to lock the moveable portion in a single direction, or only two or three directions of its full rotary motion. Furthermore, these magnetic detent configurations can preclude the moveable portion falling into an undesired position by the rejection of suitably-placed like poles. This would be in addition to a guiding mark on the mounting base to which a conventional arrow or index on the rotary portion would be directed.

While 12 holes or slots are shown for the detent magnets, to provide attraction at the six cardianal points of the switching pattern and rejection in between these points, it is obvious that fewer or more detent magnet holes may be provided to accommodate simpler or more sophisticated settings of the rotary switch.

Similarly, while six holes have been shown for the magnets, or combinations of magnets, for the switching function, to accommodate the particular orientation of the reed-type switches shown in the typical embodiment, it is obvious that other orientations and numbers of switches are possible, within the circular configuration, to provide other desirable switching functions. Such variations of the number of reed-type switching elements spaced about the stationary portion would have presumably required a corresponding variation in the number and placement of the control magnets in the rotary portion.

Since both the rotary portion, with its control magnets, and the stationary portion with its reed-type switches are interchangeable, it is obvious that an almost unlimited variation in the switching potential of this device is possible. While the switches, in their layers, may not be variable, other layers with alternate configurations of switches can be readily available to change any desired function. The control magnets, themselves, can be added to or taken out of any of the magnet holes—or their poles reversed—to change any specific switching function.

The mounting base 10 would presumably be of any non-ferrous material, such as brass, aluminum, or plastic, that would not effect the magnetic fields of the control magnets that must penetrate the mounting base to actuate the switches. The mounting material of the switches in the stationary portions, too, would normally be of a non-ferrous substance that would not effect the magnetic fields of the control magnets. However, certain situations must be improved by the formation of a ferrous path through the various layers to focus the magnetic control fields towards the switches to be controlled.

The typical embodiment of figures 1 to 5 is shown with a square mounting base and stationary portions. This permits only a quadrature degree of orientation of the layers of the switching devices. However, it will be obvious that the mountings of the layers of switching elements must preferably be in a hexagonal form to correspond to the configuration of the control magnets shown, or may be in any other geometric form that will provide the combinations of switches and control magnets necessary to provide the desired switching function.

What is claimed is:

1. A programable, compound reed-type switch comprising a mounting base; a stationary portion secured beneath said mounting base; said stationary portion comprising at least one layer of reed-type switches positioned in a plane just below said mounting base; a moveable portion rotatably secured above said mounting base; said moveable portion comprising at least one layer of magnet holes forming a first series of magnet holes equispaced about said moveable portion, equidistant from the axis of rotation of said moveable portion, positioned in a plane just above said mounting base; at least one magnet in at least one of said magnet holes of said first series, to pass over and actuate certain of said reed-type switches in a prescribed sequence in the course of its rotation; a detent means for holding said moveable portion in at least one given position with relation to said mounting base and said stationary portion comprising a second series of magnet holes, spaced from said first series of magnet holes, about the periphery of said moveable portion; a third series of magnet holes is said mounting base, positioned to coincide with said second series of magnet holes at given intervals during the rotation of said moveable portion; at least one magnet in one of said second series of magnet holes, with one polarity directed toward said mounting base; and at least one magnet, in one of said third series of magnet holes, with its other polarity directed toward said moveable portion to arrest the motion of said moveable portion in at least one given position of said rotation of said moveable portion.

2. A programable, compound reed-type switch as in claim 1 wherein said second and third series of magnet holes are in a ring outside of said first series of magnet holes and said reed-type switches.

3. A programable, compound reed-type switch as in claim 1 having at least one magnet in one of said second series of magnet holes with its other polarity directed towards said mounting base to oppose any magnet in one of said third series of magnet holes having its other polarity directed towards said moveable portion, to reject the arrest of the motion of said moveable portion in at least one given position of said rotation of said moveable portion.

4. A programable, compound reed-type switch as in claim 1 having at least two layers of said reed-type switches, and having a second layer of magnets in certain of said first series of magnet holes to actuate said second layer of reed-type switches.

* * * * *